US005686945A

United States Patent [19]

Quate et al.

[11] Patent Number: 5,686,945

[45] Date of Patent: Nov. 11, 1997

[54] CAPPING STRUCTURES FOR ACOUSTIC PRINTING

[75] Inventors: Calvin F. Quate, Stanford; Butrus T. Khuri-Yakub; Shinya Akamine, both of Palo Alto; Babur B. Hadimioglu, Mountain View, all of Calif.

[73] Assignee: Xerox Corporation, Stamford, Conn.

[21] Appl. No.: 337,913

[22] Filed: Nov. 14, 1994

Related U.S. Application Data

[63] Continuation-in-part of Ser. No. 890,211, May 29, 1992, abandoned.

[51] Int. Cl.[6] ..... B41J 2/135

[52] U.S. Cl. ..... 347/46

[58] Field of Search ..... 347/46, 20, 44, 347/47, 75, 89, 87

[56] References Cited

U.S. PATENT DOCUMENTS

| | | | |
|---|---|---|---|
| 4,308,547 | 12/1981 | Lovelady et al. | 347/46 |
| 4,380,018 | 4/1983 | Andoh et al. | 347/46 |
| 4,697,195 | 9/1987 | Quate et al. | 347/46 |
| 5,028,937 | 7/1991 | Khuri-Yakub et al. | 347/46 |
| 5,121,141 | 6/1992 | Hadimoglu et al. | 347/46 |
| 5,450,107 | 9/1995 | Rawson | 347/46 |

*Primary Examiner*—Benjamin R. Fuller
*Assistant Examiner*—Juanita D. Stephens

[57] ABSTRACT

Acoustically thin capping structures and acoustic droplet ejectors having fluid wells and which use such capping structures to create fluid cells. The inventive capping structures permit the accurate positioning of the free surface of a fluid, permit acoustically induced fluid droplet ejection, and prevent fluid from spilling from the fluid wells. "Acoustically thin" means that the thickness of the capping structure is small enough that the acoustic energy that is lost passing through the capping structure is less than 50% of the incident acoustic energy.

11 Claims, 3 Drawing Sheets

CAPPING STRUCTURES FOR ACOUSTIC PRINTING

This is a continuation-in-part of application Ser. No. 07/890,211 which was filed on 29 May 1992, abandoned.

FIELD OF THE INVENTION

The present invention relates to techniques for retaining liquid within a cavity while permitting fluid droplets to be acoustically ejected.

BACKGROUND OF THE INVENTION

Various ink jet ejection technologies have been or are being developed. One such technology, referred to as acoustic ink printing (AIP), uses focused acoustic energy to eject droplets of a fluid, such as ink, from the free surface of that fluid onto a receiving medium. More detailed descriptions of AIP are found in U.S. Pat. Nos. 4,308,547, 4,697,195, and 5,028,937.

A concern in AIP is the spatial relationship between the acoustic energy's focal area and the free surface of the fluid. Current practice dictates that the acoustic focal area be located within about one wavelength (typically about 10 micrometers) of that free surface. While this is difficult to do reliably, various techniques have been developed for accomplishing this task. See, for example, U.S. Pat. No. 5,028,937 which discusses the use of a perforated membrane to control the subject spatial relationship. However, these techniques may not be optimum with regards to manufacturability, cost, and performance.

Compounding the difficulty of accurately positioning the free surface of the fluid is the necessity of simultaneously preventing that fluid from spilling from its holder (such as an ink well) while still permitting droplet ejection. Thus, a technique that permits accurate control of the location of a fluid's free surface, that prevents spilling, and that enables droplet ejection would be beneficial.

SUMMARY OF THE INVENTION

The present invention provides for droplet ejectors (beneficially within a print head) having acoustically thin capping structures that permit accurate location of the free surface of a fluid, that permit acoustically induced droplet ejection, and that prevent the fluid from spilling from its holder. By "acoustically thin" it is meant that the thickness of the capping structure is small enough as compared to the wavelength of the acoustic energy that the acoustic energy lost passing through the capping structure is less than 50% of the incident acoustic energy. A good rule in practice is that the thickness of the capping structure is less than 10% of the wavelength of the incident acoustic energy. The thinner the capping structure the less acoustic energy is lost passing through the capping structure. However, eventually the thickness of the capping structures becomes so thin that physical breakage is difficult to avoid.

A first embodiment capping structure is an acoustically thin slab of porous silicon placed over the aperture of a fluid holder. In operation, acoustic radiation pressure pushes fluid through the pores so that a thin film of fluid forms over the capping structure. Second and third embodiment capping structures use a solid membrane placed over the aperture of a fluid holder which is in close proximity to a fluid deposition means. Those fluid deposition means deposit films of the fluid over their associated capping structures.

BRIEF DESCRIPTION OF THE DRAWINGS

Other aspects of the present invention will become apparent as the following description proceeds and upon reference to the drawings, in which.

Figure 1:
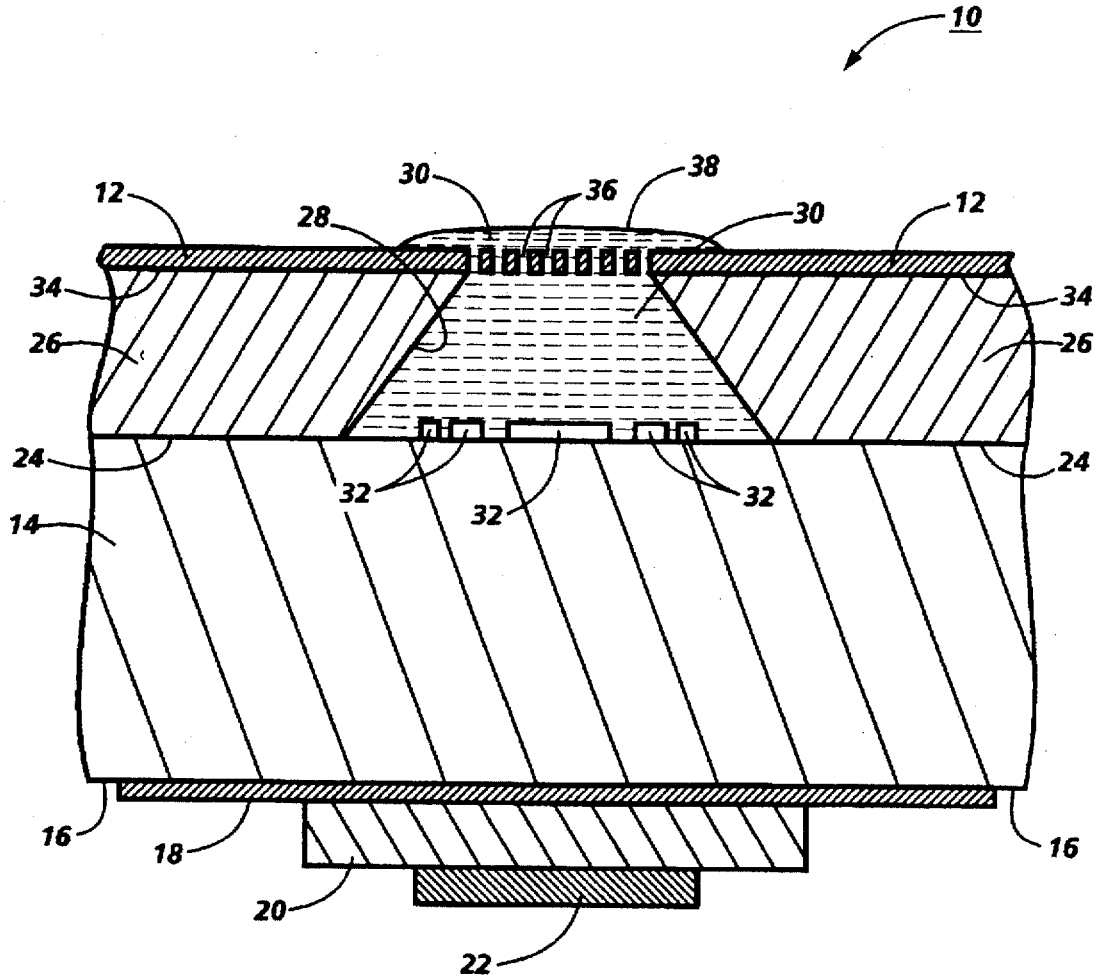
FIG. 1 provides a simplified illustration of an acoustic droplet ejector that incorporates a first embodiment capping structure.

In the drawings, like numbers designate like elements. Additionally, the subsequent text includes directional signals which are taken relative to the drawings (such as right, left, top, and bottom, lower). Those directional signals are meant to aid the understanding of the present invention, not to limit it.

DETAILED DESCRIPTION OF THE ILLUSTRATED EMBODIMENT

Refer now to FIG. 1 where an acoustic droplet ejector 10 with an acoustically thin capping structure 12 and which is in accord with the present invention is shown. The droplet ejector 10 includes a base 14 comprised of a 4" by 4" plate of 30 mil thick 7740 glass (pyrex) polished on both sides. To the back side 16 of the base is connected the front electrode 18 of a ZnO transducer 20. To generate acoustic energy, RF energy is applied to the ZnO transducer via the front electrode 18 and a gold plated back electrode 22.

To the front side 24 of the base 14 is bonded an upper substrate 26 comprised of a 300 micron thick, 3" wafer of <100> silicon which is polished on both sides and which has an etched aperture 28 formed therein. The upper substrate and the base form a fluid holder for a fluid 30 that is pumped into the aperture 28 via inlet and outlet ports (not shown). On the front surface 24 of the base 14, within the aperture 28, and axially aligned with the ZnO transducer 20 is an acoustic lens 32. The acoustic lens focuses acoustic energy that passes through the base 14 into a focal area which, as subsequently described, is located near the free surface of a pool of the fluid. While a spherical acoustic lens could be used to focus the acoustic energy, a Fresnel lens is used in the droplet ejector of FIG. 1.

The capping structure 12 attaches to the front surface 34 of the upper substrate 26 and is placed and dimensioned to completely overlie the front opening of the aperture 28. A plurality of pores 36 are formed width-wise through the capping structure. Since the capping structure 12 is silicon, the pores are beneficially formed using etching techniques well known to those that specialize in fabricating microstructures in silicon.

Acoustic energy generated by the transducer 20 forces fluid 30 through the pores 36 to form a thin pool of fluid over the capping structure. The droplet ejector is dimensioned such that the acoustic focal area is located at, or adjacent to, the free surface 38 of the pool. Since a membrane is acoustically thin (as described above in the "Summary of the Invention") it moves almost in unison with incident radiation. That radiation readily passes through the capping structure. In the droplet ejector 10, the ratio of the acoustic wavelength to the thickness of the membrane, the capping structure, is equal to about 20. Thus, droplets are readily ejected from the free surface 38. When the acoustic radiation stops, the fluid seeps back through the pores 36.

Figure 2:
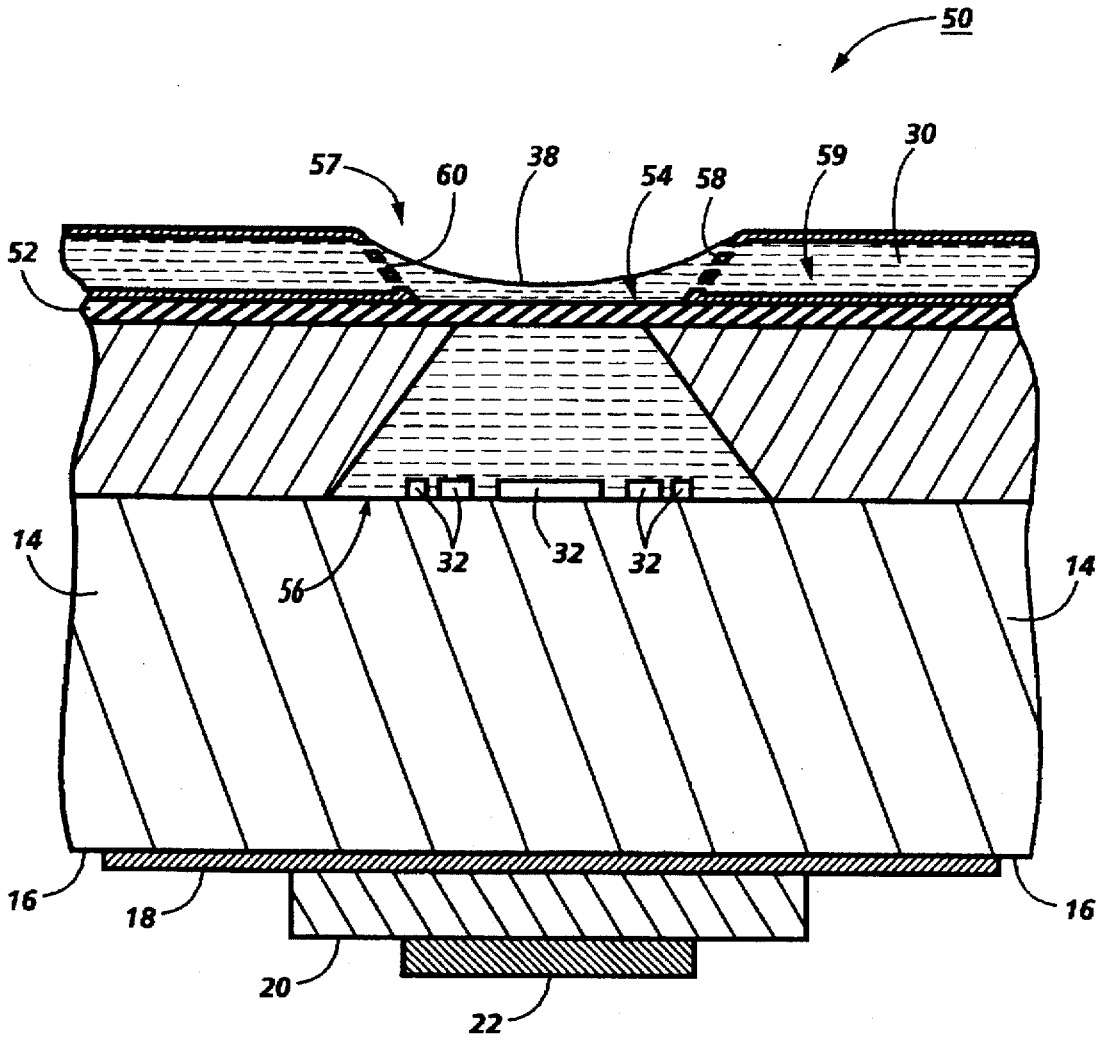
FIG. 2 provides a simplified illustration of an acoustic droplet ejector that incorporates a second embodiment capping structure.

An alternative droplet ejector 50 that uses a second embodiment capping structure 52 is shown in FIG. 2. The droplet ejector 50 is similar to the droplet ejector 10 of FIG. 1, with the differences being that (1) a capping structure 52 which does not have pores replaces the porous capping structure 12; (2) a fluid holder 54 is added in front of the capping structure 52; and (3) the former cavity formed by the capping structure 12, the base 14, and the aperture 28 is now a sealed chamber 56.

The fluid holder 54 includes an opening 57 formed by a side wall 58 and an internal chamber 59 containing fluid 30 under pressure. The fluid holder 54 is positioned so that the opening 57 is located over the sealed chamber 56. A plurality of pores 60, which provide paths for fluid to flow into the opening 57, are formed through the side wall 58. In operation, pressure forces the fluid 30 through the pores 60 so as to create a thin pool of fluid 30 on the capping structure over the sealed chamber 56. The droplet ejector 58 is dimensioned such that the free surface 38 of that pool is at or is near the acoustic focal area. Since the capping structure 52 is acoustically thin (as described above in the "Summary of the Invention"), acoustic energy can readily eject fluid droplets from the pool.

Figure 3:
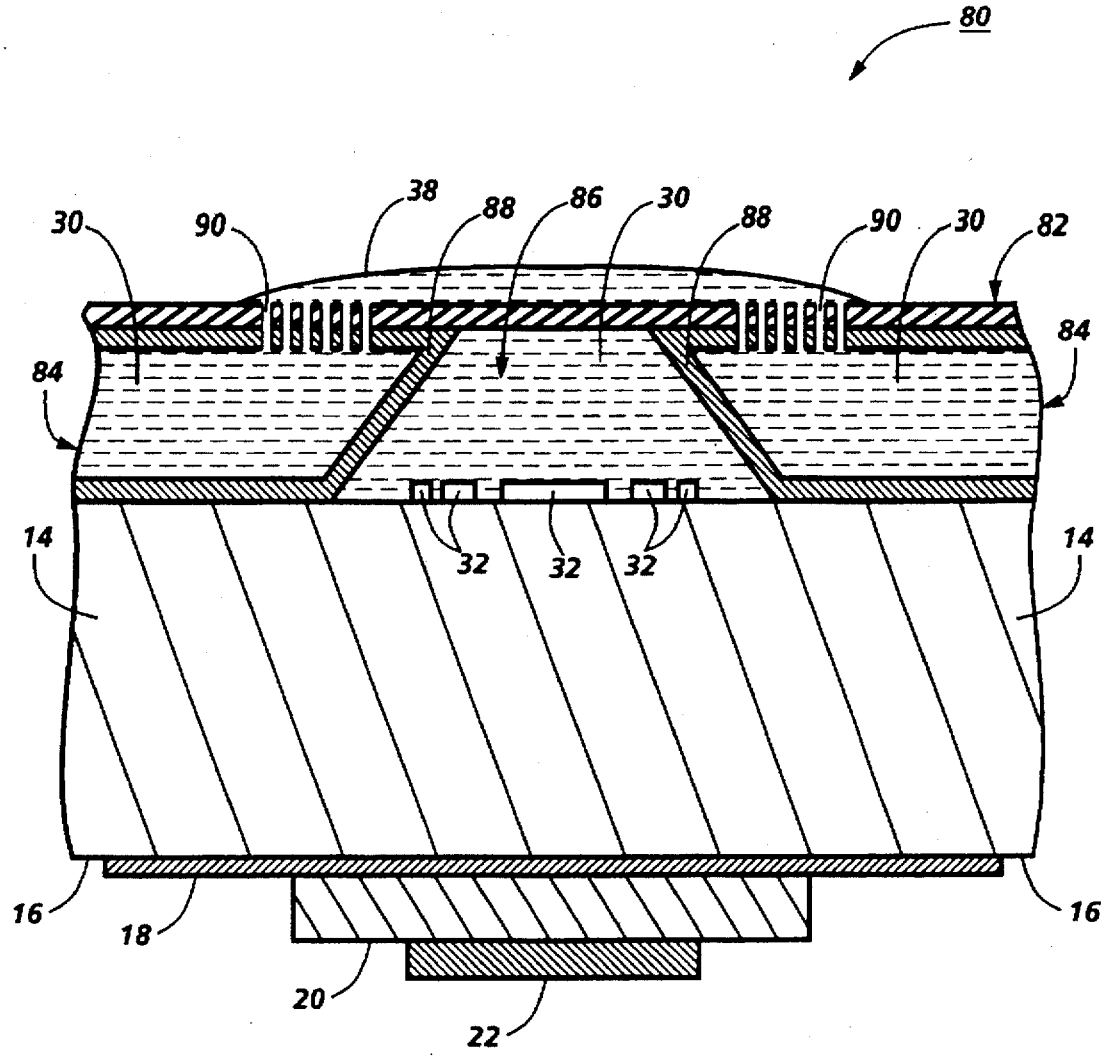
FIG. 3 provides a simplified illustration of an alternate acoustic droplet ejector that incorporates a third embodiment capping structure.

Another droplet ejector 80, which uses a third embodiment capping structure 82, is illustrated in FIG. 3. The base 14, the transducer 20 (and its electrodes. 16 and 22), and the acoustic lens 32 are the same as those illustrated in the previous embodiments. However, the solid upper substrate 26 in those embodiments is replaced by a fluid container 84 filled with the fluid 30. The container 84 also includes an aperture 86. That aperture, whose location and function is analogous to the aperture 28 of FIGS. 1 and 2, is formed by container walls 88.

The capping structure 82 is placed above the container 84 such that it seals the aperture 86. Adjacent to the aperture 86 are a plurality of pores 88 that enable fluid 30 to pass from the container 84 and through the capping structure 82 so to form a pool of fluid 30 over the aperture 86. The droplet ejector 80 is dimensioned such that the free surface 38 of that pool is at or is near the acoustic focal area. Since the capping structure 82 is acoustically thin, the acoustic energy from the transducer 20 can readily pass through the capping structure to eject droplets from the pool.

It is to be understood that while the figures and the above description illustrate the present invention, they are exemplary only. Others who are skilled in the applicable arts will recognize numerous modifications and adaptations of the illustrated embodiment which will remain within the principles of the present invention. Therefore, the present invention is to be limited only by the appended claims.

What is claimed:

1. A droplet ejector comprising:

a body having a top surface and a bottom surface;

a transducer for emitting acoustic energy to pass through said body from said bottom surface to said top surface;

means for focusing said acoustic energy into a focal area at a predetermined position above said body;

an upper substrate having an aperture, said upper substrate joined to said body such that said aperture forms a cavity and such that said acoustic energy focused by said focusing means passes through said aperture;

a volume of material filling said cavity;

a capping structure contacting said volume of material, the capping structure comprising a wafer that transmits at least 50% of incident acoustic energy, said wafer having an inner surface and an outer surface, said inner surface joined to said upper substrate such that said capping structure seals said cavity; and a fluid container comprised of a top wall, a bottom wall, an interior wall that defines an opening, and an interior chamber for holding fluid, said bottom wall joined to said outer surface of said wafer so the said opening axially aligns with said cavity, said interior wall containing a plurality of pores for enabling fluid in said chamber to pass into said opening to form a pool of fluid having a free surface on said outer surface of the wafer.

2. The apparatus according to claim 1 wherein said capping structure is silicon.

3. The apparatus according to claim 2 wherein said pores are formed by etching.

4. A capping structure for an acoustic droplet ejector having a fluid well and an acoustic transducer for generating acoustic energy having a wavelength through said fluid well, said capping structure comprised of a wafer having a thickness which is less than 10% of said wavelength and which is dimensioned to cover the fluid well so as to retard fluid from spilling from said fluid well.

5. The capping structure according to claim 4 wherein said wafer is silicon.

6. The capping structure according to claim 5 wherein said wafer includes a plurality of pores through a thickness of said wafer so as to enable fluid to pass though said wafer.

7. A droplet ejector for ejecting a fluid, comprising:

a transducer for emitting acoustic energy having a wavelength in the fluid;

means for focusing said acoustic energy acoustically coupled to the transducer, with said acoustic energy being focused into a focal area;

a fluid well acoustically coupled to the focusing means, the fluid well having an opening, with said fluid well holding fluid so that said acoustic energy passes through said fluid and out of said opening; and a capping structure comprised of a wafer which has a thickness which is less than 10% of said wavelength and which has a plurality of pores that enable fluid in said fluid well to pass through said capping structure, said capping structure attached to the fluid well to cover said opening so that fluid that passes through said pores forms a pool having a free surface over said opening.

8. A droplet ejector for ejecting a fluid, comprising:

a body having a top surface and a bottom surface;

a transducer for emitting acoustic energy to pass through said body from said bottom surface of the body to said top surface of the body;

means for focusing said acoustic energy into a focal area at a predetermined position above said body;

a fluid container comprised of a top wall, a bottom wall, an interior wall that defines an aperture through said fluid container, and an interior chamber for holding fluid, said top wall containing a plurality of pores adjacent to said aperture, said pores for enabling fluid in said chamber to pass through said top wall, said bottom wall of said fluid container joined to said top surface of said body such that said acoustic energy having a wavelength in said fluid is focused by said focusing means to pass through said aperture; and a capping structure joined to said top wall of said fluid container and overlaying said aperture, said capping structure comprised of a wafer which has a thickness which is less than 10% of said wavelength and which has a plurality of pores adjacent said aperture for enabling fluid to pass from said pores of said fluid container through said capping structure to form a pool of fluid having a free surface over said capping structure so that said free surface is over said aperture.

9. The droplet ejector according to claim 8 wherein said wafer is silicon.

10. A droplet ejector for ejecting a fluid, comprising:

a body having a top surface and a bottom surface;

a transducer for emitting acoustic energy having a wavelength in said fluid to pass through said body from said bottom surface of the body to said top surface of the body;

means for focusing said acoustic energy into a focal area at a predetermined position above said body;

an upper substrate having an aperture, said upper substrate joined to said body such that said aperture forms a cavity and such that said acoustic energy having a wavelength in a volume of material filling said cavity is focused by said focusing means to pass through said aperture;

a capping structure comprised of a wafer which has a thickness which is less than 10% of said wavelength and which has an inner surface and an outer surface, said inner surface joined to said upper substrate such that said capping structure seals said cavity; and a fluid container comprised of a top wall, a bottom wall, an interior wall that defines an opening, and an interior chamber for holding fluid, said bottom wall joined to said outer surface of said wafer so the said opening axially aligns with said cavity, said interior wall containing a plurality of pores for enabling fluid in said chamber to pass into said opening to form a pool of fluid having a free surface on said outer surface of the wafer.

11. The droplet ejector according to claim 9 wherein said wafer is silicon.

* * * * *